United States Patent [19]

Sagan

[11] 3,998,268

[45] Dec. 21, 1976

[54] LOCKING DEVICE FOR STAGGERED FIN-TUBES

[75] Inventor: Stanley S. Sagan, Springfield, Pa.

[73] Assignee: Westinghouse Electric Corporation, Pittsburgh, Pa.

[22] Filed: Mar. 4, 1975

[21] Appl. No.: 555,214

[52] U.S. Cl. ..... 165/162; 165/172; 165/178; 122/510; 211/60 R; 248/68 R; 248/73

[51] Int. Cl.[2] ..... F28B 9/00

[58] Field of Search ..... 165/82, 162, 172, 178; 122/510; 248/68 R, 73; 211/60 R, 8, 4

[56] References Cited

UNITED STATES PATENTS

| | | | |
|---|---|---|---|
| 2,231,462 | 2/1941 | Cobb | 248/68 R |
| 2,328,039 | 8/1943 | Toomey et al. | 165/172 |
| 3,545,534 | 12/1970 | Coles | 122/510 |
| 3,854,529 | 12/1974 | Sagan | 165/162 |

FOREIGN PATENTS OR APPLICATIONS

| | | | |
|---|---|---|---|
| 743,474 | 12/1943 | Germany | 122/510 |
| 842,494 | 6/1952 | Germany | 122/510 |
| 764,866 | 1/1957 | United Kingdom | 165/162 |

*Primary Examiner*—C. J. Husar
*Attorney, Agent, or Firm*—F. J. Baehr, Jr.

[57] ABSTRACT

A locking bar having feet which engage staggered finned-tubes of a heat exchanger to fix their positions in a support assembly formed from a plurality of support bars having interlocking arms.

8 Claims, 14 Drawing Figures

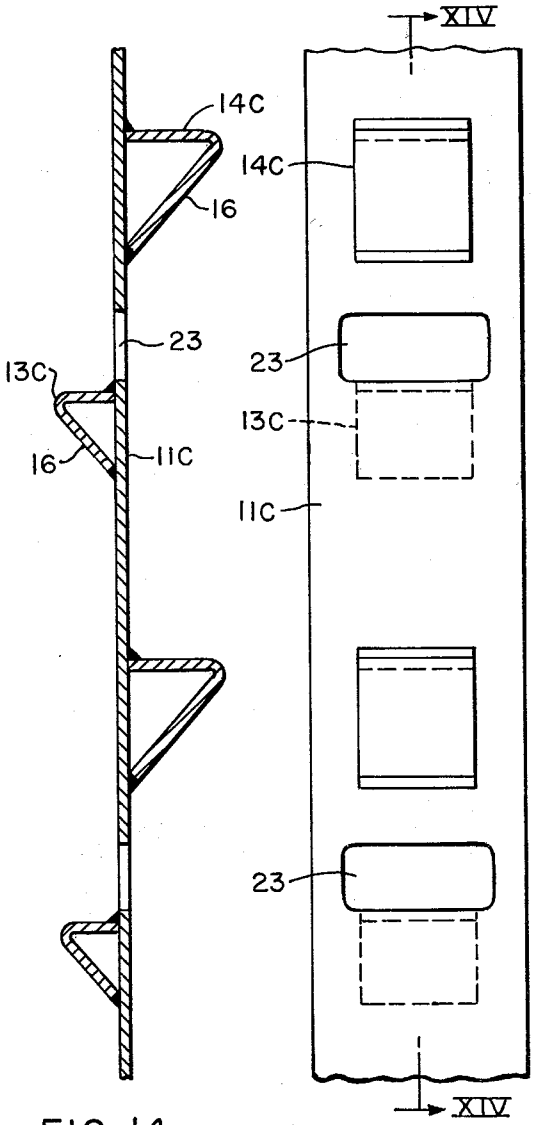
FIG. 13
FIG. 14
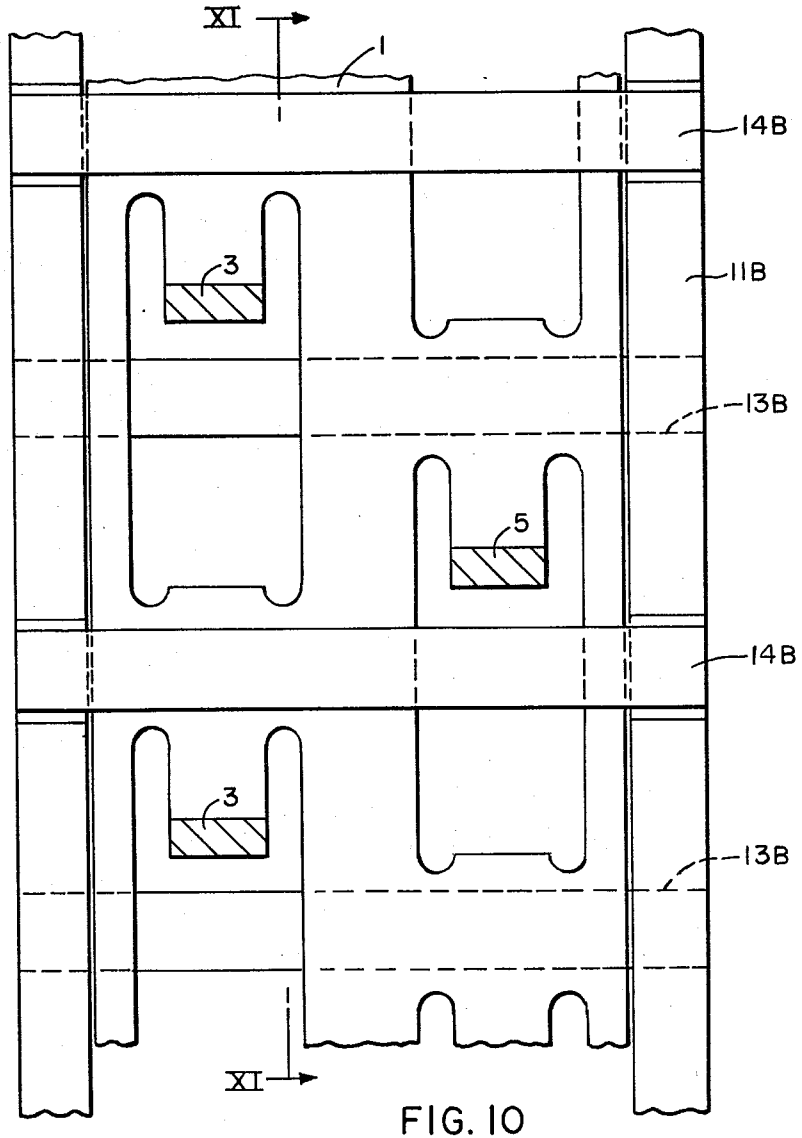
FIG. 10
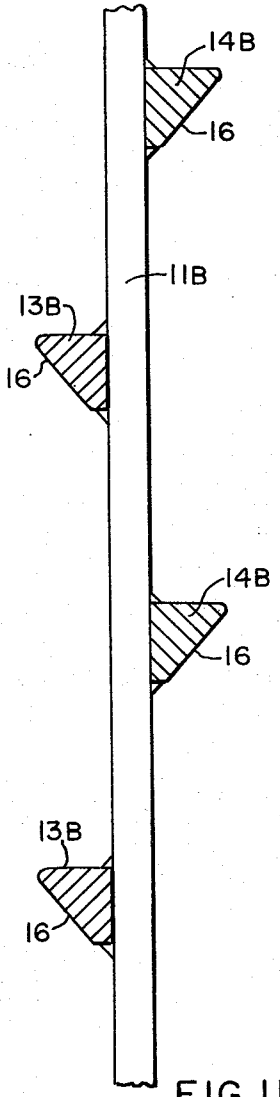
FIG. 11

LOCKING DEVICE FOR STAGGERED FIN-TUBES

BACKGROUND OF THE INVENTION

1. Field of the Invention

This invention relates to heat exchanger supports and more particularly to a system for locking staggered finned tubes in position.

2. Description of the Prior Art

A similar support system was described in U.S. Pat. No. 3,854,529 granted to this inventor Dec. 17, 1974. The specification describes in detail such a support system which is hereby incorporated by reference into this specification.

Finned tubes are advantageously utilized to transfer heat from a gas to a liquid and to optimize the heat transferred, it is desirable to stagger adjacent rows of tubes in order to further enhance the heat transfer characteristics of such tubes. Fixing the position of long finned tubes becomes a problem and requires special attention particularly where the temperatures are high.

When heat exchangers are operated at high temperatures and pressures tube failures are inherent to any such heat exchanger and an economical support system requires that one or more of the tubes must be easily removed and replaced.

SUMMARY OF THE INVENTION

In general a support and locking system or closely packed staggered finned tubes of a heat exchanger, when made in accordance with this invention, comprises a plurality of support bars having two sets of arms which are generally normal to the support bars and extend outwardly from one side thereof. One set of arms is normally disposed one-half pitch out of phase with respect to the other set of arms. The support bars have openings which register with the arms of adjacent support bars to support the distal ends of the arms. Adjacent support bars are normally mirror images so as to facilitate interlocking. Such a system also comprises a plurality of locking bars slidably disposed generally parallel to the support bars. The locking bars having feet which extend from the locking bars so as to engage the finned tubes to hold them in staggered rows.

BRIEF DESCRIPTION OF THE DRAWINGS

The objects and advantages of this invention will become more apparent from the following detailed description in connection with the accompanying drawings in which:

FIG. 10 is a partial elevational view of the other alternate locking bar;

FIG. 11 is a partial sectional view of locking bar taken on line XI—XI of FIG. 10.

FIG. 13 is a partial sectional elevational view of alternate locking bar; and

FIG. 14 is a sectional view taken on line IV—IV of FIG. 13.

DESCRIPTION OF THE PREFERRED EMBODIMENTS

Figure 1:
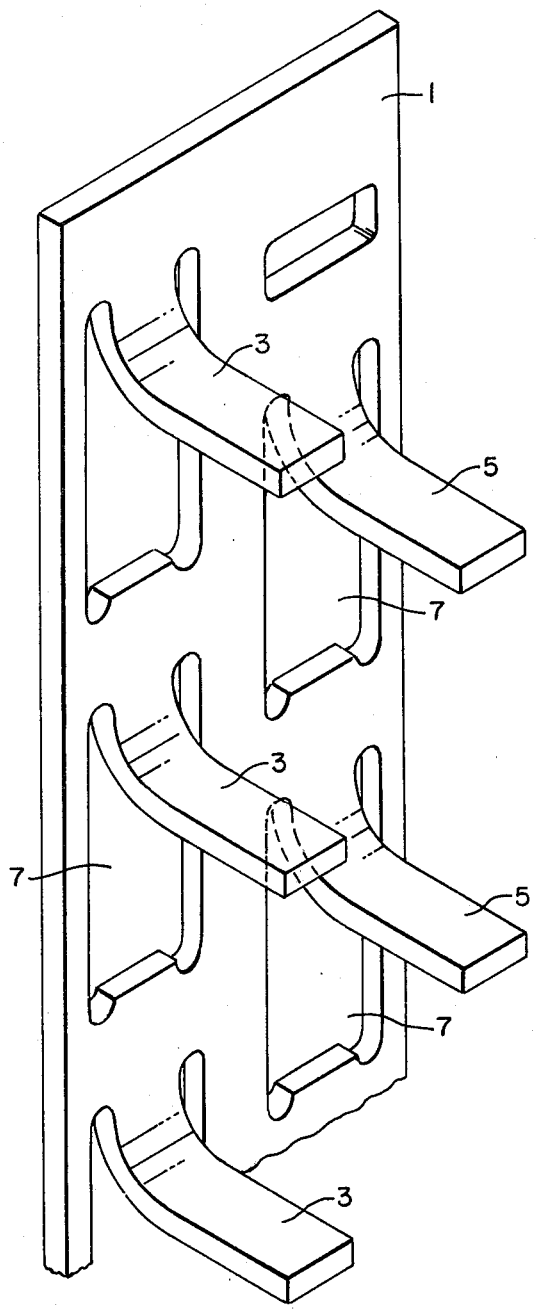
FIG. 1 is an isometric view of a support bar.
Figure 2:
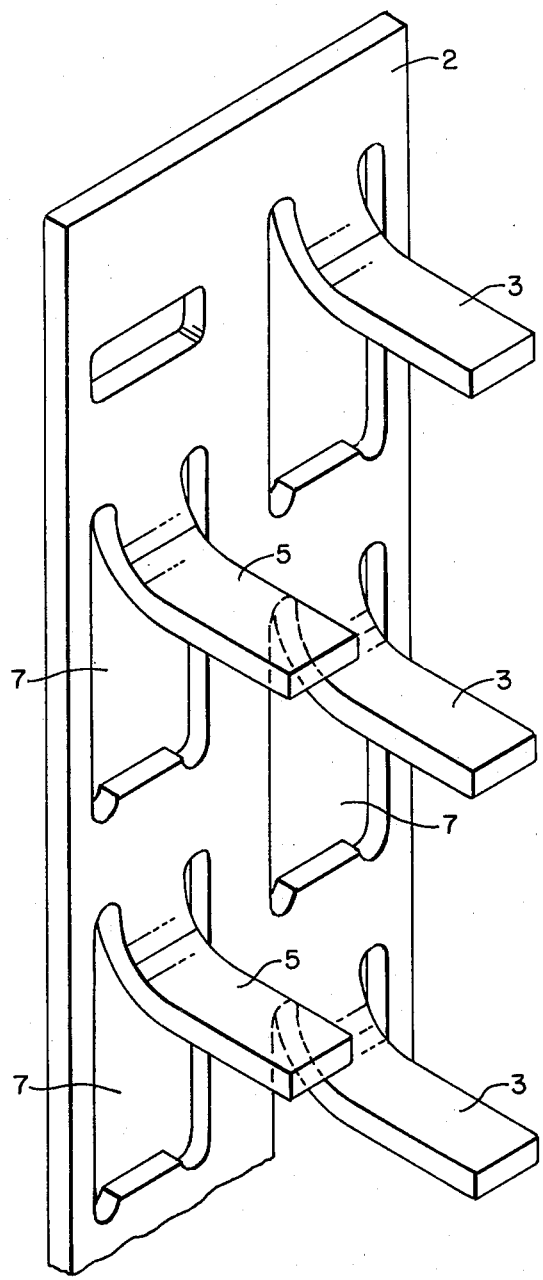
FIG. 2 is an isometric view of an adjacent support bar.

Referring now to the drawings in detail and in particular to FIGS. 1 and 2 there is shown support bars 1 and 2 having two sets of arms 3 and 5 disposed normal or perpendicular to the support bars 1 and 2. The arms 3 and 5 are formed by cutting portions of the support bar and bending the cut portions generally 90° to form the arms 3 and 5, thus leaving openings 7 in the bars. A set of arms 3 or 5 is disposed adjacent each longitudinal margin of the support bars 1 and 2. One set of arms 3 is disposed one-half pitch out of phase with respect to the other set of arms 5.

The support bar 2 with arms 3 and 5 shown in FIG. 2 is a mirror image of the support bar 1 with arms 3 and 5 shown in FIG. 1. Stated in another manner, the arms of the support bar 2 shown in FIG. 2 are bent in the opposite direction from the arms of the support bar 1 shown in FIG. 1.

Figure 3:
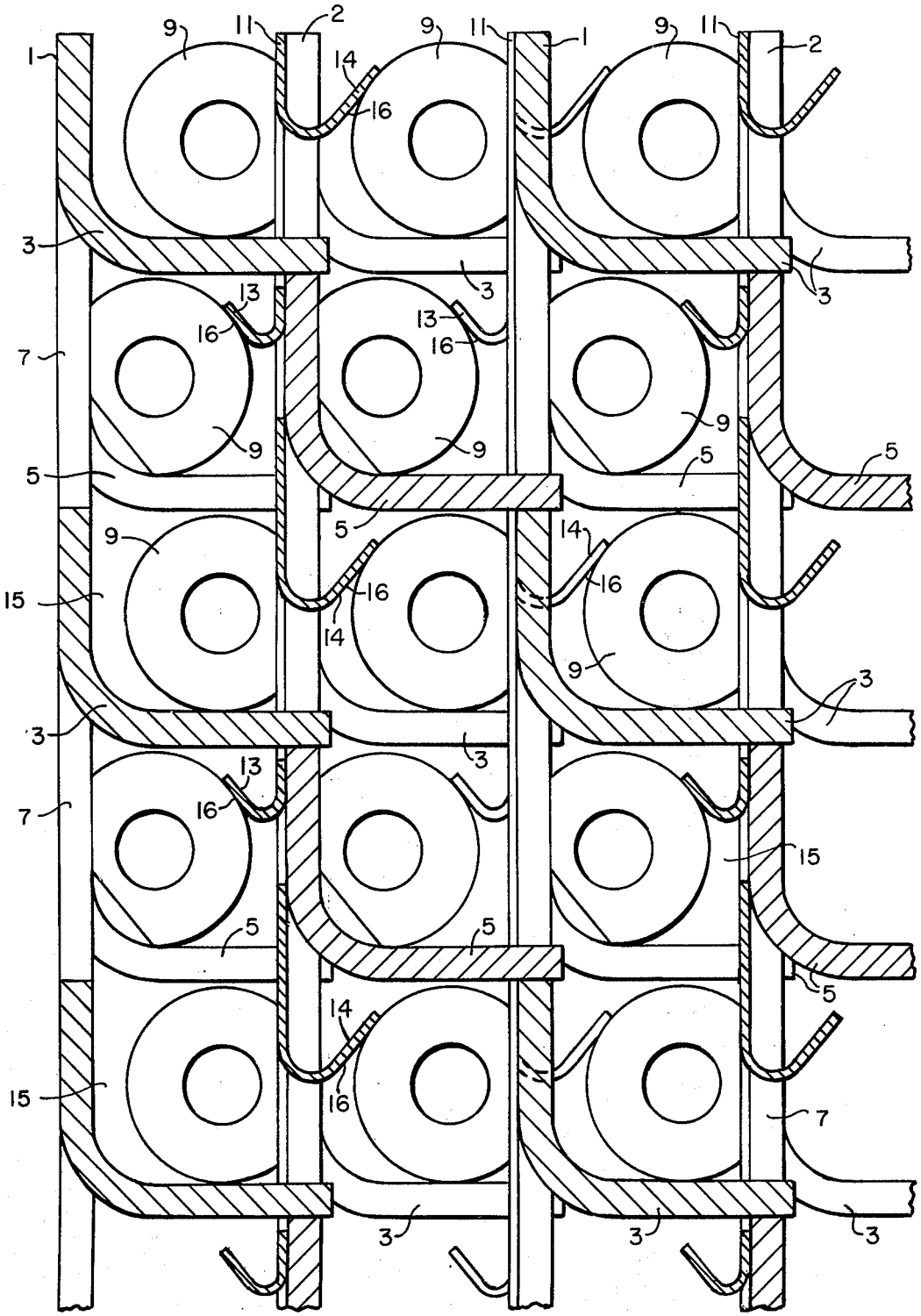
FIG. 3 is a partial sectional view of an array of support bars, tubes and locking bars made in accordance with this invention.

FIG. 3 shows the support bars 1 and 2 disposed in an interlocking arrangement to support a plurality of finned tubes 9. A plurality of locking bars 11 are slidably disposed generally parallel to and in engagement with the support bars 1 and 2. The locking bars 11 have feet 13 and 14 which extend outwardly from each side of the locking bar 11 to engage the finned tube 9 disposed on opposite sides of the locking bar 11 to lock the finned tubes 9 in a staggered position when the locking bar 11 is in its locking or downward position. The locking bar 11 may slide upwardly freeing the finned tubes 9 so that the finned tubes may be pulled through openings 15 formed by the arms 3 and 5 of the support bars 1 and 2. The feet 13 and 14 are formed with inclined surfaces 16 which engages the finned tubes 9. The feet 13 extending from one side of the locking bar 11 are one-half pitch out of phase with respect to the feet 14 extending from the other side of the locking bar 11 in the embodiment shown in FIG. 3 the feet 13 on one side of the locking bar 11 are substantially smaller in size than the feet 14 extending from the other side of the locking bar. This difference in the feet sizes is dictated by the necessity of taking into account the thickness of the support bars 1 and 2 as the larger feet fit through the openings 7 in the support bars 1 and 2.

FIG. 3 also shows the locking bars 11 so disposed with respect to the support bars 2 so as to be able to slide lengthwise with respect to the support bars, whereby when slid in one direction, downwardly, the feet 13 and 14 engage the finned tubes 9 to hold them in place and when slid in the opposite direction, upwardly, the feet 13 and 14 move away from the finned tubes 9 freeing them so they may be removed from the support assembly for repair or replacement.

The finned tubes 9 have selected portions of the fins cut away to provide a vertical space in the closely packed bundle of staggered finned tubes 9 for the support bars 1 and 2 and locking bars 11. In the example shown in FIG. 3 (as well as in other Figures of this disclosure) the staggering is such that each horizontal row is offset less than one-half pitch with respect to the adjacent horizontal row. In other cases, however, the staggering could be symmetrical, i.e. offset exactly one-half pitch. The actual amount of staggering possible to achieve with such a system will depend on the ratio of the bare tube diameter (before finning) to the spacing available between the vertical members of support bars 1 and 2.

Figure 4:
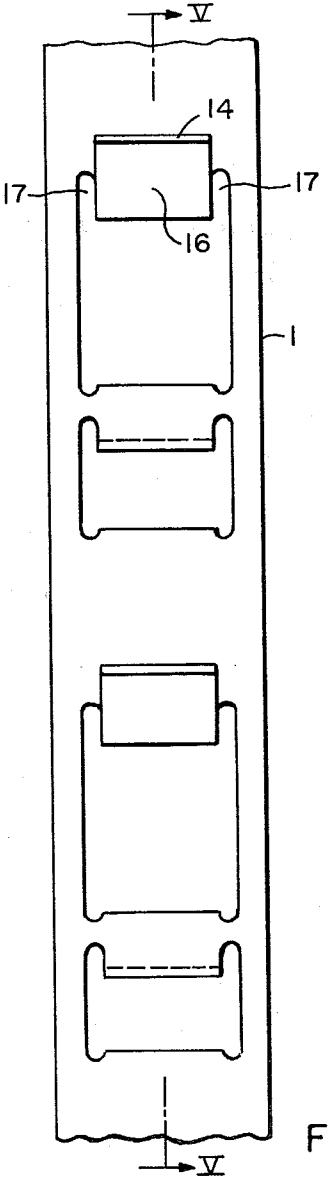
FIG. 4 is a partial elevational view of a locking bar made in accordance with this invention.
Figure 5:
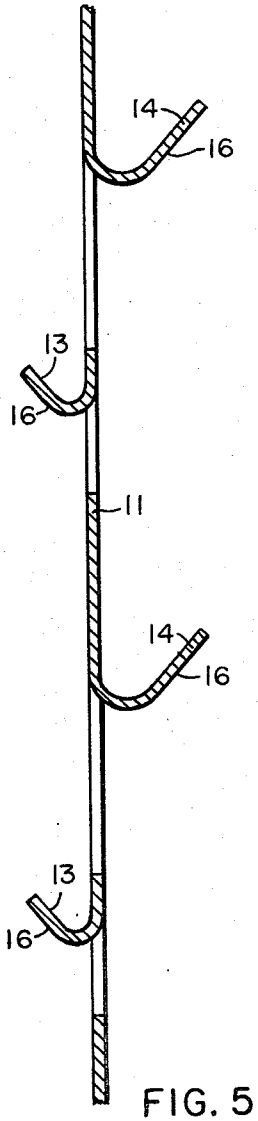
FIG. 5 is a partial sectional view taken on line V—V of FIG. 4.

FIGS. 4 and 5 show how the locking bar 11 and feet 13 and 14 are formed. Slots 17 are punched in each side of the portions of the bar which will become the feet 13 and 14 and then the distal end of the feet are cut or sheared and the feet are bent to produce the inclined surface 16 which contacts the finned tubes 9.

Figure 6:
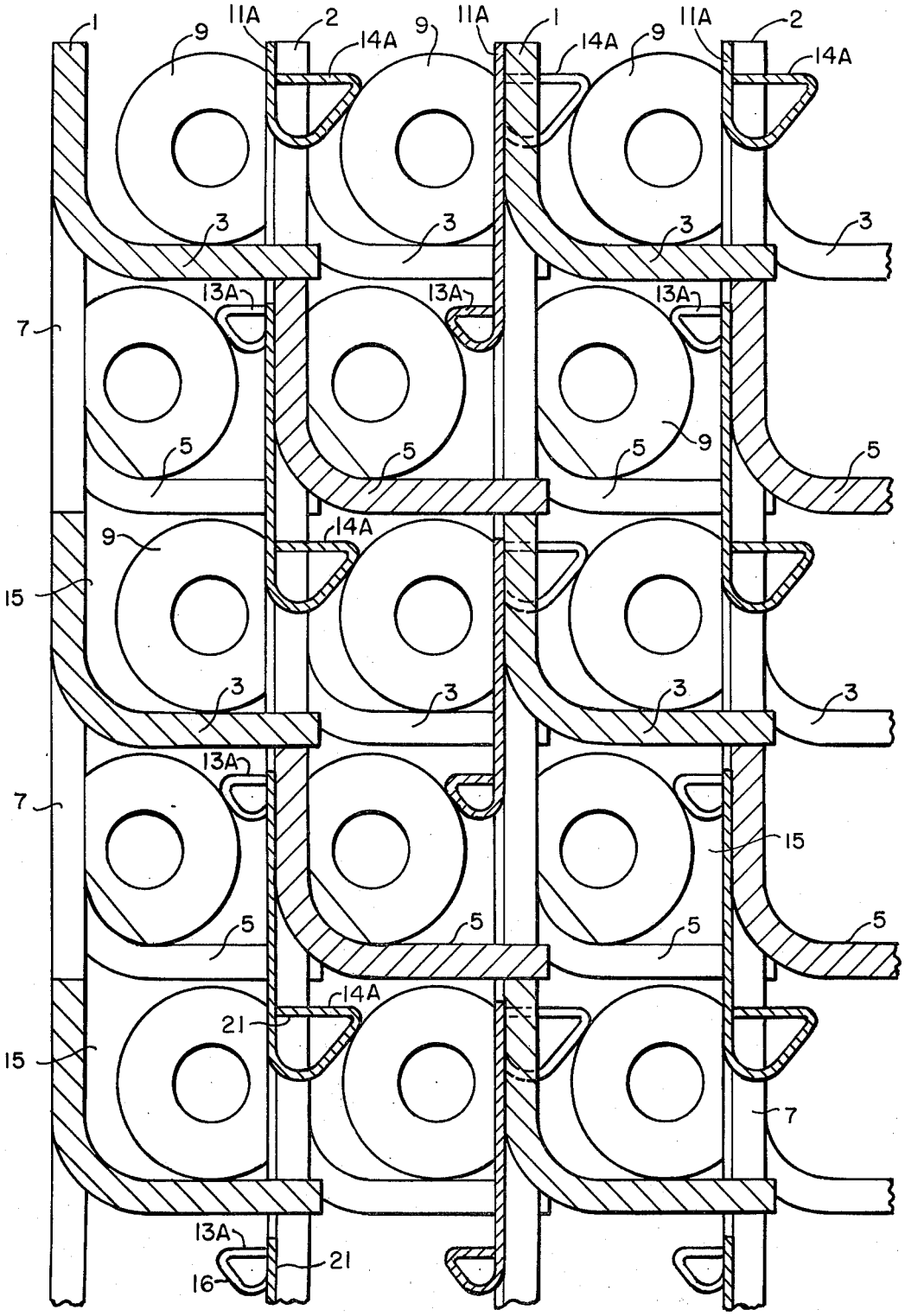
FIG. 6 is a partial sectional view of an array of support bars, tubes and alternate locking bars.

In FIG. 6 there is again shown an array of finned tubes 9 and support bars 1 and 2 and alternate locking bars or system 11A.

Figure 7:
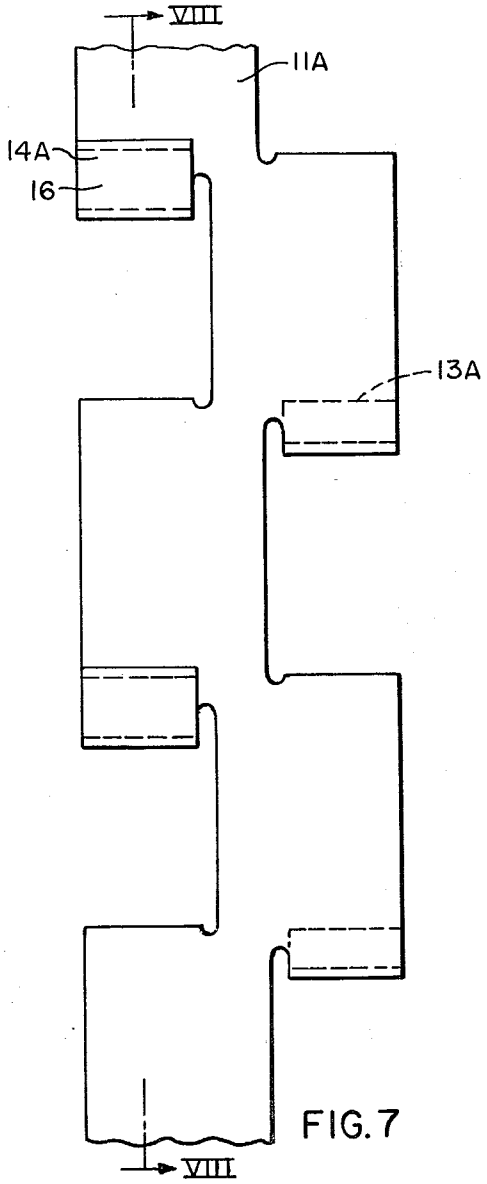
FIG. 7 is a partial sectional view of an alternate locking bar.
Figure 8:
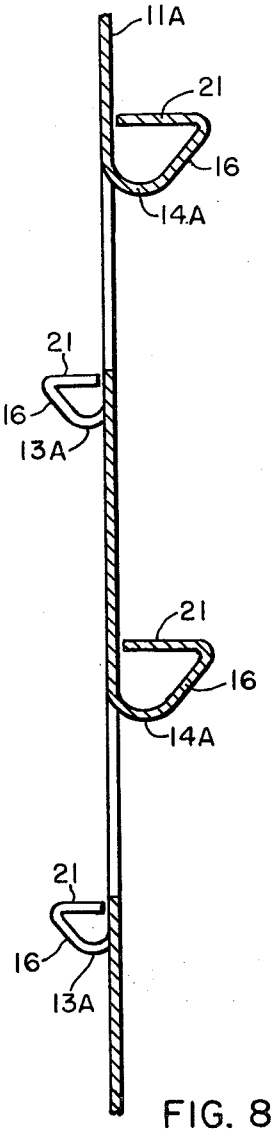
FIG. 8 is a sectional view taken on line VIII—VIII of FIG. 7.

As shown in FIGS. 7 and 8, the locking bars 11A have feet 13A and 14A which have a siffener 21 which extends from the inclined surface 16 to the bar 11A, forming a loop which increases the rigidity of the feet 13A and 14A. The feet 13A and 14A are cut from opposite margins of the locking bar 11A to provide the extra material for the stiffener 21. The feet 14A are disposed to register with openings 7 left by the arms of the support bar 1 or 2 and pass therethrough to engage the finned tubes 9 on the other side of the support bar.

Figure 9:
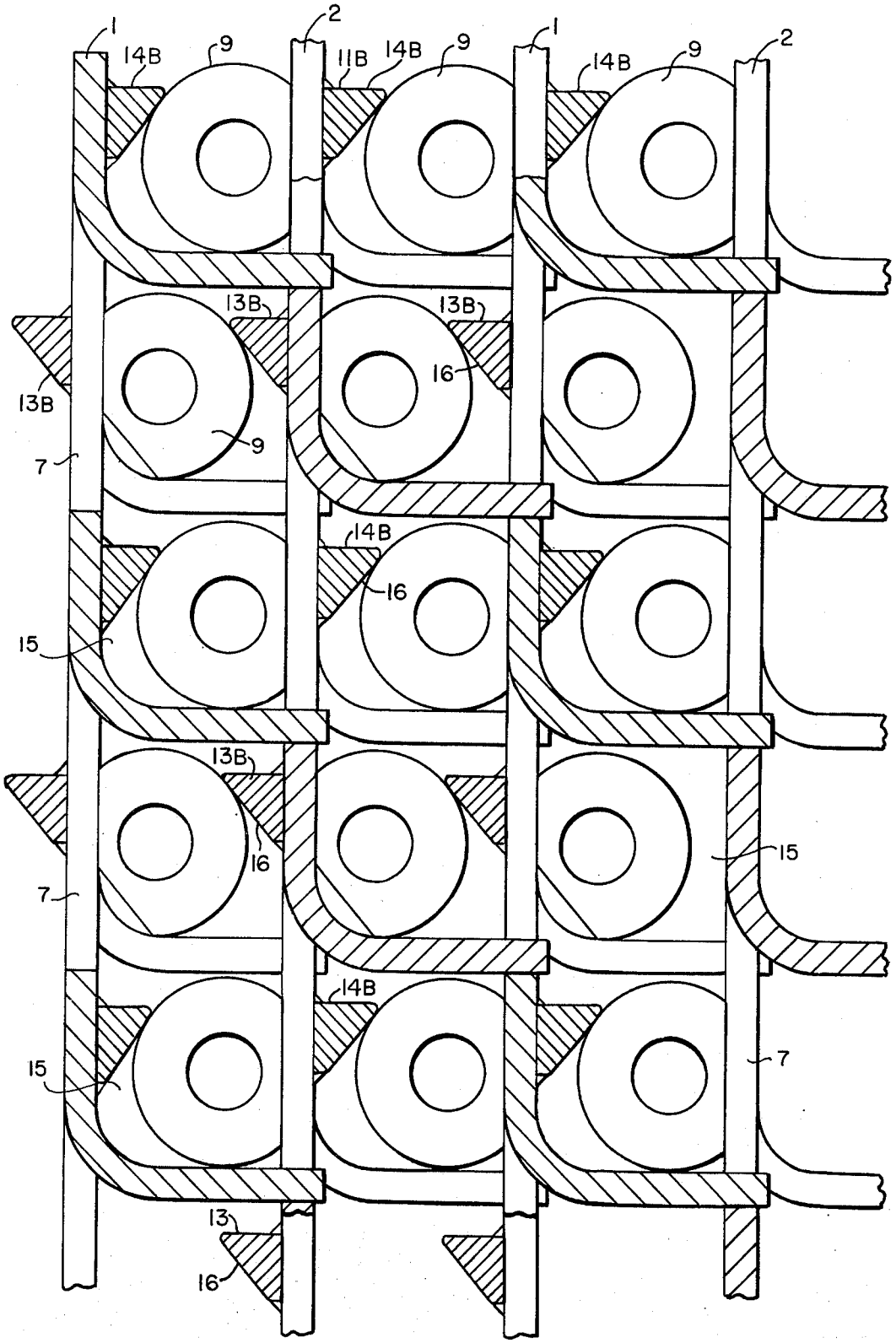
FIG. 9 is a partial sectional view of an array of support bars, tubes and still other alternate locking bars.

FIG. 9 shows an array of finned tubes 9, support bars 1 and 2 and another alternate locking bar or system 11B.

The locking bars or system 11B, as shown in FIGS. 10 and 11 generally comprises two parallel bars 11B slidably disposed on each side of the support bar 1 and 2. Feet 13B and 14B are attached to opposite sides of the bars 11B by welding or other means. The feet are preferably solid bars which have an inclined surface 16 disposed to engage the finned tubes 9.

Figure 12:
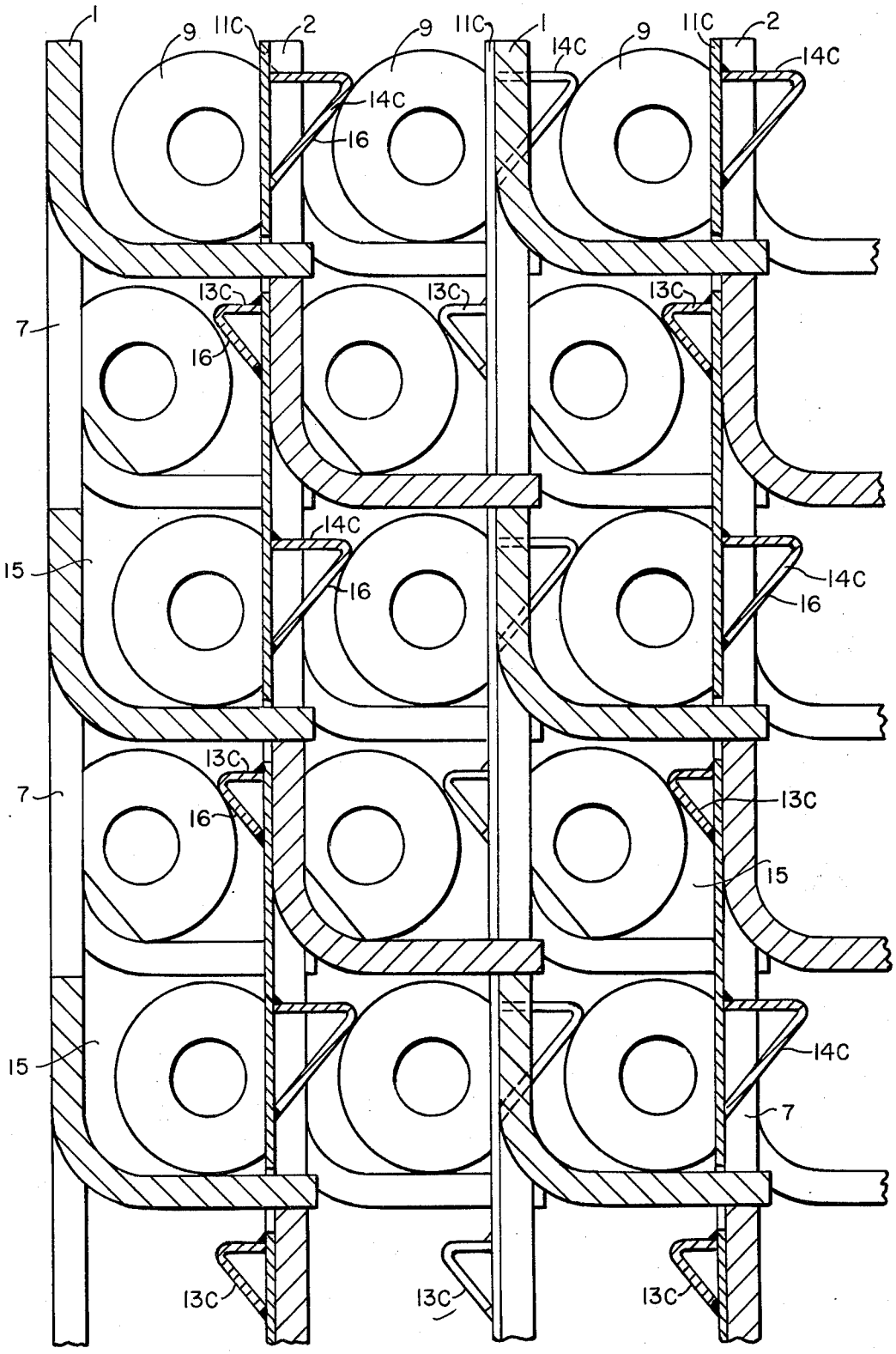
FIG. 12 is a partial sectional view of an array support bars, tubes and still another alternate locking bar.

Still another array of finned tubes 9, support bars 1 and 2 and another alternate locking device 11C is shown in FIG. 12.

The locking bars or system 11C, as shown in FIGS. 13 and 14, comprise a bar 11C having feet 13C and 14C disposed on opposite sides thereof, the feet 13C being substantially smaller than the feet 14C. The feet 13C and 14C comprise angular-shaped bars bent to produce an inclined surface 16 for contacting the finned tubes 9 to hold the finned tubes in a staggered position. The feet 13C and 14C are fastened to the bars 11C by welding or other means. The bars have an opening 23 which registers with the arms 3 or 5 of support bars 1 or 2. One set of the arms passes through the opening 23 to position the locking bars with respect to the support bars 1 and 2.

The support bars and locking bars described hereinbefore advantageously lock the tubes in a staggered arrangement when in their downward position and provide a simple method of unlocking the tubes so that they may be removed from the support bars by simply moving the locking bar upwardly with respect to the support bars to provide room for the finned tubes to slide through the openings 15 between the arms and the support bars, thus providing a simple sturdy and economical system for supporting and positioning staggered tubes for closely packed tube bundles which is economical to produce and reliable.

What is claimed is:

1. Support and locking apparatus for closely packed staggered tubes of a heat exchanger, said apparatus comprising a plurality of support bars having two sets of arms which are generally normal to said support bars and extend outwardly from one of the sides thereof, one set of arms being one-half pitched out of phase with respect to the other set of arms, said support bars having openings which register with the arms of the adjacent support bars to support the distal end of said arms, adjacent support bars being mirror images so as to interlock, and a plurality of locking bars disposed generally parallel to said support bars, said locking bars having feet which extend from said locking bars so as to engage the tubes to hold the tubes in position, said locking bars slidably engaging said support bars so as to be able to slide lengthwise with respect to said support bars, whereby when slid in one direction the feet engage the tubes and when slid in the opposite direction the feet move away from the tubes freeing said tubes so that they may be removed from said support bars.

2. Apparatus as set forth in claim 1, wherein the feet include an inclined surface which engages the finned tubes.

3. Apparatus as set forth in claim 1, wherein the feet include an inclined surface which engages the finned tubes and is disposed at an acute angle with respect to the locking bars.

4. Apparatus as set forth in claim 1, wherein the locking bars slidably engage a major surface of the support bar.

5. Apparatus as set forth in claim 1, wherein the feet extend from both sides of the locking bars.

6. Apparatus as set forth in claim 5, wherein the feet on one side of the locking bar are one tube pitch out of phase with respect to the feet on the other side of the locking bar.

7. Apparatus as set forth in claim 6, wherein the feet on side of the locking bar are substantially larger than the feet on the other side of the locking bar.

8. Apparatus as set forth in claim 1, wherein the tubes are finned tubes and the fins are trimmed so as to be able to be disposed in staggered position within the support assembly.

* * * * *